US007665549B2

(12) United States Patent
Lyon

(10) Patent No.: US 7,665,549 B2
(45) Date of Patent: Feb. 23, 2010

(54) ENTRAINMENT FLUID CHANNELING DEVICE FOR A DOWN-HOLE DRILL STRING

(75) Inventor: Leland H. Lyon, Roanoke, VA (US)

(73) Assignee: Atlas Copco Secoroc AB (SE)

( * ) Notice: Subject to any disclaimer, the term of this patent is extended or adjusted under 35 U.S.C. 154(b) by 443 days.

(21) Appl. No.: 11/628,998

(22) PCT Filed: Jun. 24, 2005

(86) PCT No.: PCT/US2005/022330

§ 371 (c)(1),
(2), (4) Date: Dec. 8, 2006

(87) PCT Pub. No.: WO2006/012240

PCT Pub. Date: Feb. 2, 2006

(65) Prior Publication Data

US 2008/0011517 A1 Jan. 17, 2008

Related U.S. Application Data

(60) Provisional application No. 60/583,200, filed on Jun. 25, 2004.

(51) Int. Cl.
*E21B 10/60* (2006.01)
*E21B 17/18* (2006.01)
*E21B 21/12* (2006.01)

(52) U.S. Cl. ..... 175/393; 175/100; 175/215; 175/231

(58) Field of Classification Search ..... None
See application file for complete search history.

(56) References Cited

U.S. PATENT DOCUMENTS

| | | | | |
|---|---|---|---|---|
| 2,765,146 | A | 10/1956 | Williams, Jr. | |
| 2,805,043 | A | 9/1957 | Williams, Jr. | |
| 3,786,878 | A * | 1/1974 | Chapman | 175/320 |
| 4,534,426 | A | 8/1985 | Hooper | |
| 4,771,835 | A | 9/1988 | Eaton | |
| 6,367,566 | B1 | 4/2002 | Hill | |

* cited by examiner

*Primary Examiner*—Zakiya W. Bates
(74) *Attorney, Agent, or Firm*—Michael Best & Friedrich LLP

(57) ABSTRACT

A fluid channeling device (10) is for a down-hole drill assembly (1) having a central axis (1*c*) and advanceable into a hole in a downward direction (D) along the axis (1*c*). The assembly (1) includes a drill member (2) with an inner surface (2*a*) bounding a central bore (2*b*) and an outer surface (2*c*). The channeling system includes at least one passage (12) provided within the drill member (2) so as to extend generally between the drill member inner (2*a*) and outer surfaces (2*c*). A generally annular channeling member (14) is disposeable about a portion of the drill member (2) and has at least one inlet port (20), at least one discharge port (16), and a passage (12) extending between the inlet (20) and discharge ports (16). The inlet port (20) is fluidly connectable with the drill member passage (12) to fluidly couple the central bore (2*b*) with the discharge port (16). The discharge port (16) is configured to direct fluid generally externally of the drill assembly (1) and generally in an upward direction (U) along the axis (1*c*).

32 Claims, 6 Drawing Sheets

ENTRAINMENT FLUID CHANNELING DEVICE FOR A DOWN-HOLE DRILL STRING

RELATED APPLICATIONS

This application is a 371 of PCT/US2005/022330, filed on Jun. 24, 2005, which claims the benefit of U.S. provisional Pat. Appl. 60/583,200, filed on Jun. 25, 2004.

BACKGROUND OF THE INVENTION

The present invention relates to down-hole drill strings, and more particularly to devices for channeling working fluid within such drill strings.

Many deep-hole drilling applications require large volumes of air to provide ample hole cleaning velocity and "cuttings lift". Proper drill performance necessitate removal of cuttings from a work hole as they are produced by the drill to maintain a "clean" hole and prevent plugging or loss of fluid circulation. While working fluid, such as compressed air, is normally expelled at the bottom of the hole, it is also desirable to expel or discharge fluid at various depths in the work hole where supplemental fluid flow/velocity may be beneficial. However, there are generally limitations as the quantity or volume of fluid that can be circulated with a down-hole drill ("DHD") due to the internal geometry or structure of the DHD. Additionally, drill performance will be negatively affected by excessive internal backpressure that generally results from bypassing flow to create such supplemental flow. Further, most DHD's must be taken apart to make flow adjustments, which is usually a time consuming process that should only be performed by qualified service staff.

Furthermore, commercially available devices commonly referred to as "Jet Subs" are known for providing such desired air flows. However, these devices are rather complex, require incorporation of a separate device into the drill string, and prone to failure and thus generally unreliable. For example, these devices typically include throttle orifices that are protected from back-flow (to prevent debris from entering the clean high pressure air supply) with a spring check valve. Such check valves often break and allow contamination into the drill string.

SUMMARY OF THE INVENTION

In one aspect, the present invention is a fluid channeling device for a down-hole drill assembly, the drill assembly having a central axis, being advanceable into a hole in a downward direction along the axis, and including at least one drill member. The drill member has an inner circumferential surface bounding a central bore and an outer circumferential surface. The fluid channeling device comprises at least one passage provided within the drill member so as to extend generally between the drill member inner and outer surfaces. A generally annular channeling member is disposeable about a portion of the drill member and having at least one inlet port, at least one discharge port, and a passage extending between the inlet and discharge ports. The inlet port is fluidly connectable with the drill member passage so as to fluidly couple the central bore with the discharge port. Further, the discharge port is configured to direct fluid generally externally of the drill assembly and generally in an upward direction along the axis.

In another aspect, the present invention is again a fluid channeling device for a down-hole drill assembly. The fluid channeling device comprises a first drill member having an inner surface bounding a central bore, an outer surface, and at least one passage extending generally between the drill member inner and outer surfaces. A channeling member is disposeable about a portion of the first drill member and has at least one inlet port, at least one discharge port, and a passage extending between the inlet and discharge ports. The inlet port is fluidly connectable with the drill member passage so as to fluidly couple the central bore with the discharge port. The discharge port is configured to direct fluid generally externally of the drill assembly. Further, a second drill member is connectable with the first drill member and contactable with the channeling member so as to retain the channeling member disposed upon the first drill member.

In a further aspect, the present invention is a down-hole drill assembly comprising an elongated drill member having a central axis, an inner circumferential surface bounding a central bore, an outer circumferential surface, and a passage extending generally between the inner and outer surfaces. The drill member is advanceable into a hole in a generally downward direction along the axis. A generally annular channeling member is disposeable about a portion of the drill member and has an inlet port, a discharge port, and a passage extending between the inlet port and the discharge port. The inlet port is fluidly connectable with the drill member passage so as to fluidly connect the drill member central bore with the discharge port. Further, the discharge port is configured to direct fluid generally externally of the drill assembly and generally in an upward direction along the central axis.

In yet another aspect, the present invention is again a fluid channeling device for a down-hole drill, the drill including first and second members. The first drill member has a radial end surface, an inner surface bounding a central bore and an outer surface and the second drill member has a radial end surface. The fluid channeling device comprises a passage provided within the first drill member and extending between the first member inner and outer surfaces and a channeling member. The channeling member is disposeable about a portion of the first drill member and has an inlet port, a discharge port, and a passage extending between the inlet port and the discharge port. The inlet port is fluidly connectable with the first drill member passage so as to fluidly connect the central bore with the discharge port and the discharge port is configured to discharge fluid generally externally of the drill assembly. Further, the end surface of each one of the first and second drill members contacts the channeling member to retain the channeling member disposed about the first member portion.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
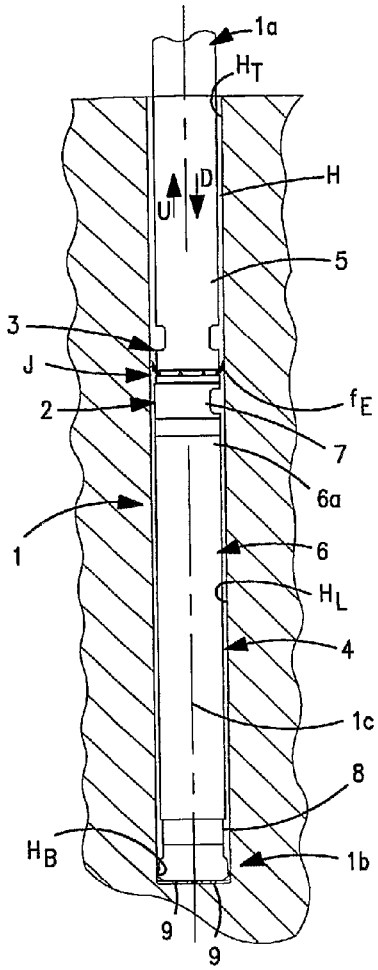
FIG. 1 is a partly broken-away, elevational view of a drill string including a fluid channeling device in accordance with the present invention, shown disposed in a work hole.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the words "lower", "upper", "upward", "down" and "downward" designate directions in the drawings to which reference is made. The words "inner", "inwardly" and "outer", "outwardly" refer to directions toward and away from, respectively, a designated axis or a geometric center of an element being described, the particular meaning being readily apparent from the context of the description. The terminology includes the words specifically mentioned above, derivatives thereof, and words or similar import.

Figure 7:
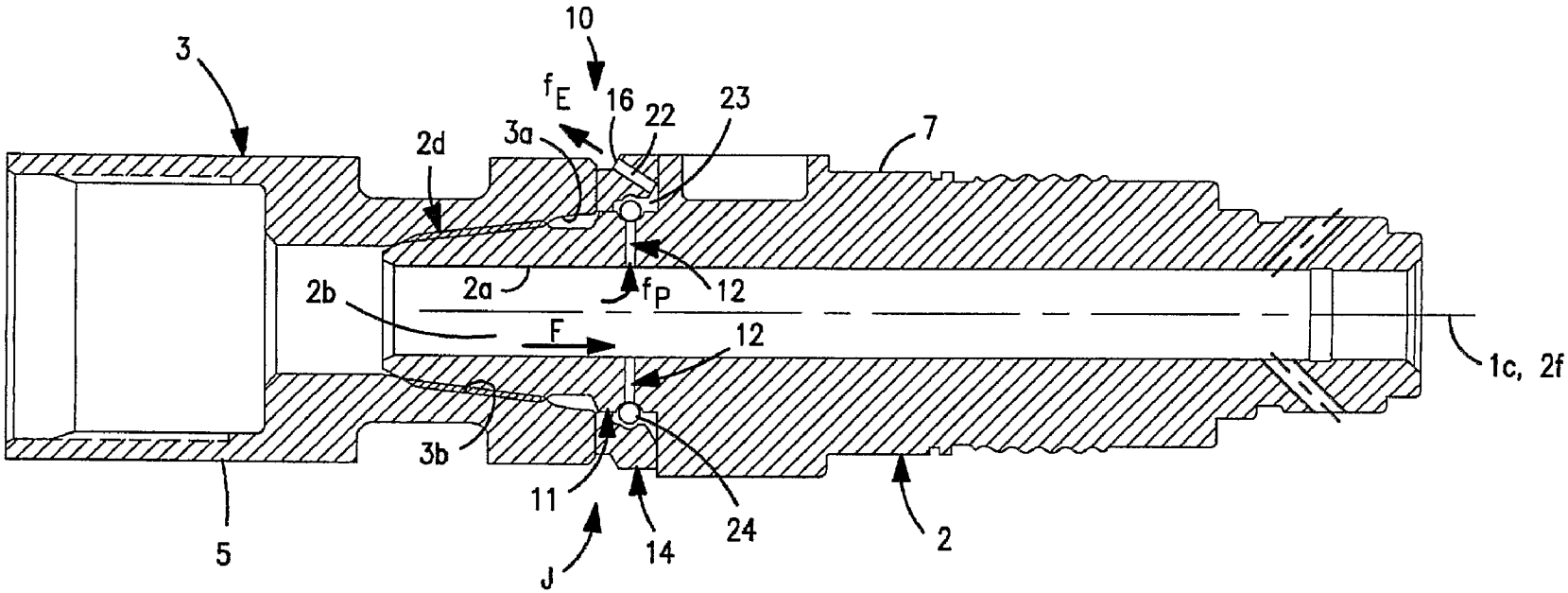
FIG. 7 is an axial cross-sectional view of a fluid channeling device shown disposed between two drill members.
Figure 8:
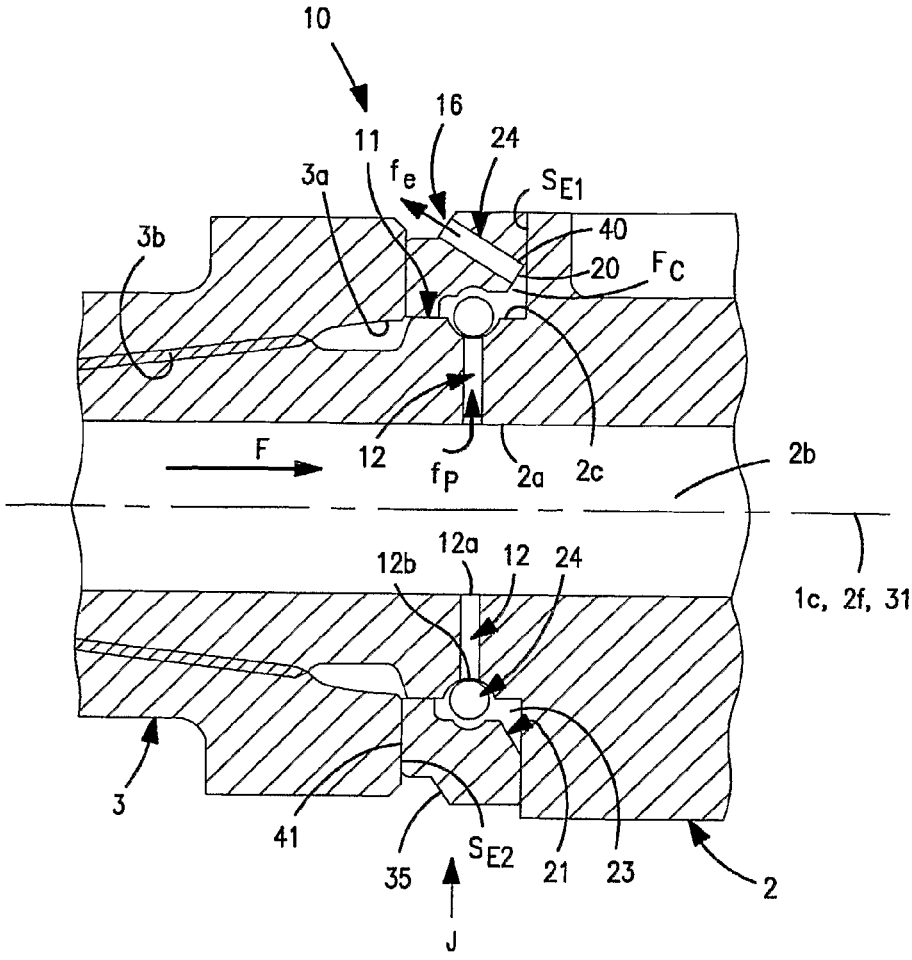
FIG. 8 is a greatly enlarged, broken-away view of the fluid channeling device and drill members of FIG. 7.

Referring now to the drawings in detail, wherein like numbers are used to indicate like elements throughout, there is shown in FIGS. 1-10 a presently preferred embodiment of a fluid channeling device 10 for a down-hole drill assembly 1, preferably a drill "string" 1, disposeable within a work hole H and having upper and lower ends 1*a*, 1*b*, respectively, and a central axis 1*c* extending between the ends 1*a*, 1*b*. The drill string 1 is advanceable into the hole H in a downward direction D along the axis 1*c* and includes at least a first drill member 2 and a second drill member 3 connectable with the first member 2, and a fluid-activated percussive drill 4. The percussive drill 4 may provide one of the two members 2, 3 or be merely connected with the two members 2, 3, as discussed below. Further, the first drill member 2 has an inner circumferential surface 2*a* bounding a central bore 2*b*, the bore 2*b* being fluidly connectable with a source of working fluid (not shown), and an outer circumferential surface 2*c*, as best shown in FIGS. 7 and 8. The channeling device 10 of the present invention basically comprises at least one and preferably a plurality of passages 12 provided within the first drill member 2 and a generally annular channeling member 14 disposeable about a "base" portion 11 of the first drill member 2. The channeling member 14 has at least one and preferably a plurality of discharge ports 16, each port 16 being configured to direct fluid $f_E$ generally externally of the drill string 1 (i.e., outside the drill string components, but within the hole H) and generally in an upward direction U along the axis 1*c*.

Specifically, each drill member passage 12 extends generally between the first member inner and outer surfaces 2*a*, 2*c* and is configured to fluidly connect the drill member bore 2*b* with the one or more discharge ports 16, as described below. The drill member passage(s) 12 each have an inlet 12*a* located at the member inner surface 2*a* and an outlet 12*b* located at the member outer surface 2*b*. The channeling member 14 includes at least one and a preferably a plurality of inlet ports 20 and at least one and preferably a plurality of passages 22. Each channeling member passage 22 extends between a separate one of the inlet ports 20 and a separate one of the discharge ports 16. The one or more channeling member inlet ports 20 are fluidly connectable with the drill member passage(s) 12 to fluidly connect the drill member central bore 2*b* with the discharge port(s) 16, and thereby establish a flow path between the bore 2*b* and the work hole H.

Figure 2:
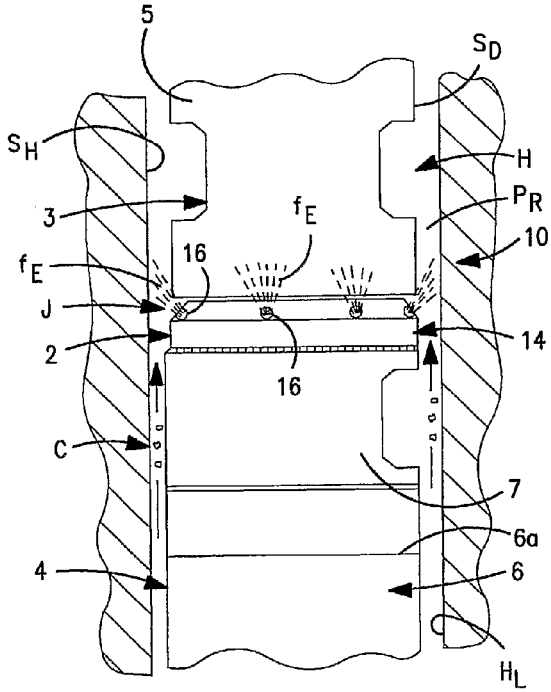
FIG. 2 is an enlarged, broken-away section of the drill string of FIG. 1.
Figure 3:
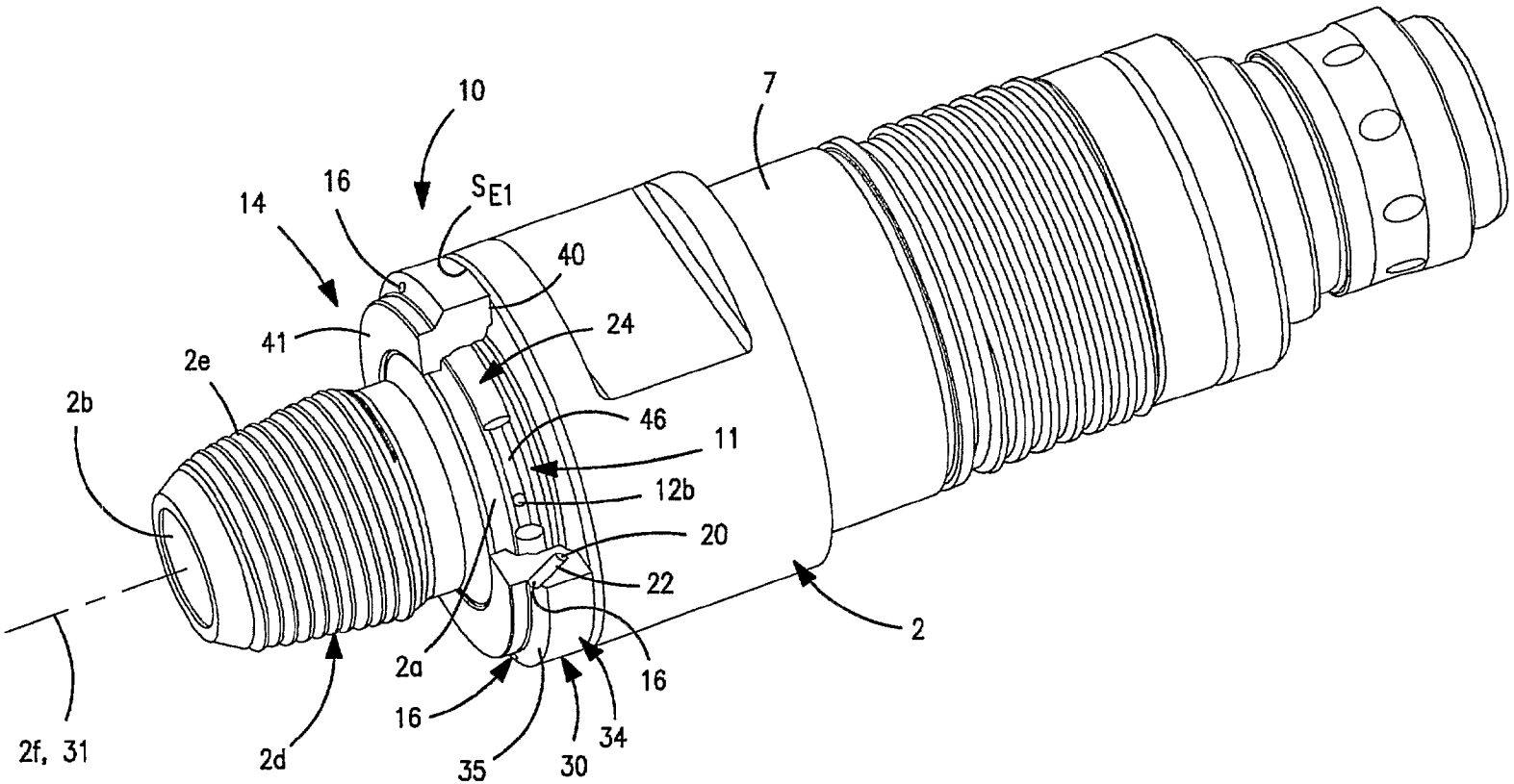
FIG. 3 is a perspective view of a drill member including the fluid channeling device.
Figure 4:
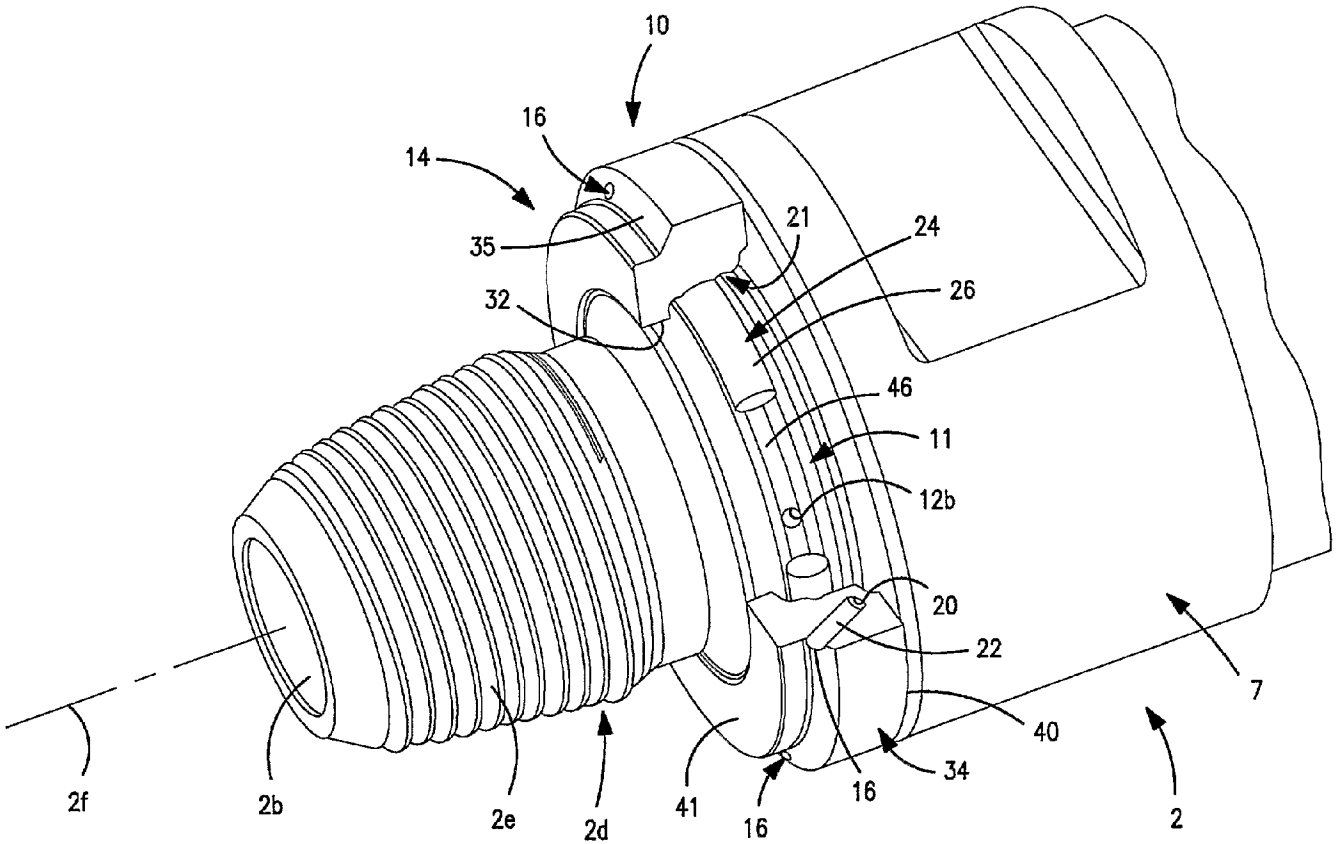
FIG. 4 is an enlarged, broken-away perspective view of the drill member and channeling device of FIG. 3.
Figure 5:
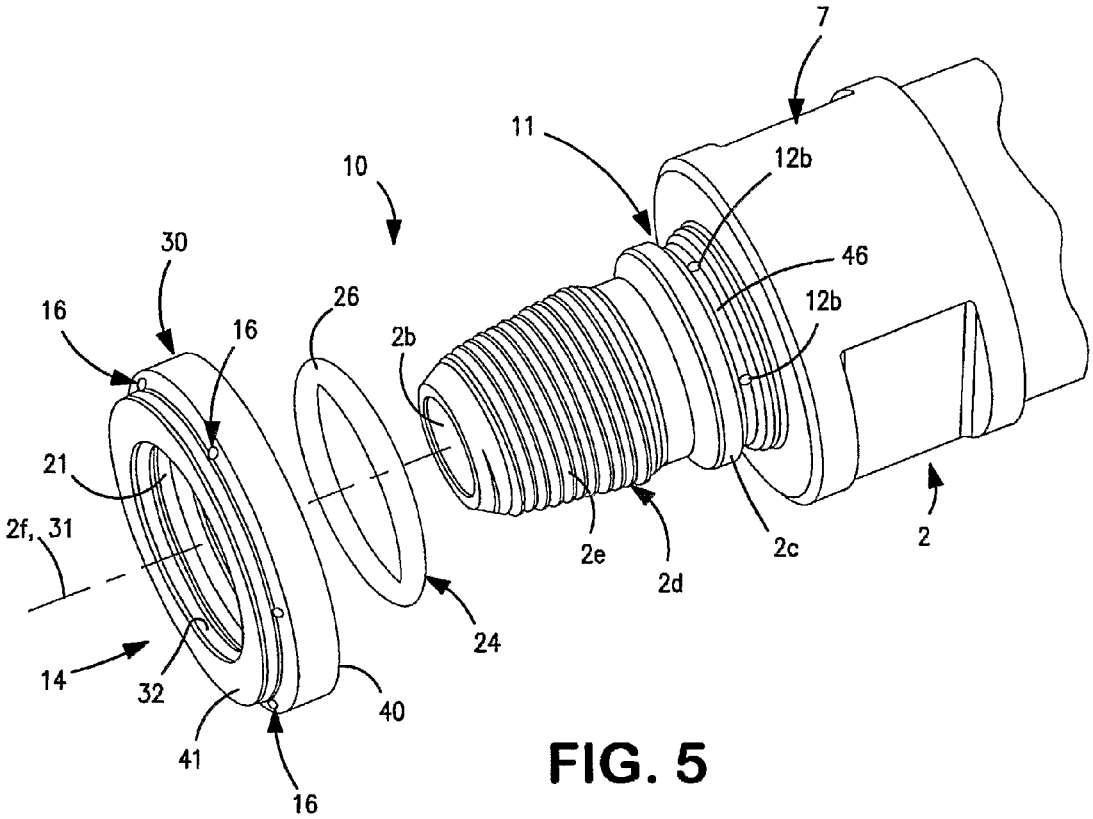
FIG. 5 is an exploded view of the fluid channeling device and the drill member shown in FIG. 4.
Figure 6:
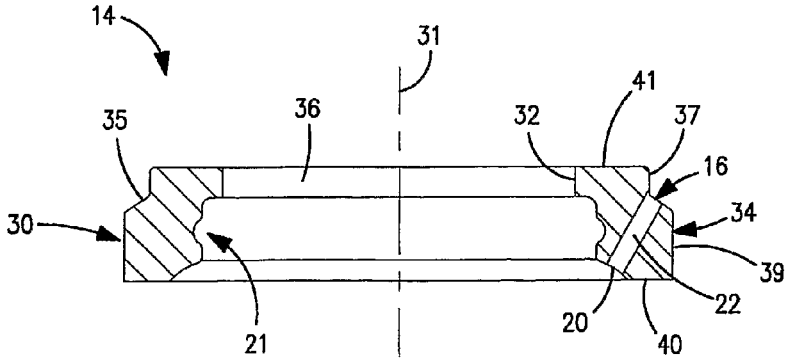
FIG. 6 is a greatly enlarged axial cross-sectional view of a channeling member of the channeling device.

With the above structure, when the drill string 1 contains working fluid F (e.g., compressed air) within the first member central bore 2*b*, a portion $f_P$ of the fluid flows through the drill member passage(s) 12, through the channeling member passage(s) 22 and out of the discharge port(s) 16. Further, as described above, each discharge port 16 is preferably configured to direct fluid $f_E$ flowing out of the particular discharge port 16 in a direction generally along the drill central axis 1*c* and generally toward the drill upper end 1*a*. As such, when the drill string 1 is disposed within a work hole H (i.e., a hole being formed by the drill string 1), fluid flow $f_E$ out of the discharge port(s) 16 entrains debris C (i.e., drill chips, rock cuttings, soil clumps, dirt particles, etc.) located within the hole H to displace in the upward direction U toward the drill string upper end la, so as to thereby be removed from the hole H. Specifically, as depicted in FIG. 2, the drill hole H has an inner circumferential surface $S_H$ and the drill string 1 has an outer circumferential surface $S_D$ (including the drill member outer surface 2*c*) spaced radially inwardly from the hole inner surface $S_H$ so as to define a generally annular removal passage $P_R$, and debris C entrained by the fluid flow $f_E$ displaces generally through the removal passage $P_R$ and out of the hole upper end $H_T$. Thus, the fluid channeling device 10 basically functions to create one or more entrainment fluid flows $f_E$ for removing material within the work hole H, and also reduces backpressure within the percussive drill 4, as discussed in greater detail below.

Preferably, the channeling member 14 (as shown) or the first drill member 2 (structure not shown) has a circumferentially-extending interior recess 21 located such that when the channeling member 14 is disposed on the drill member base portion 11, the recess 21 provides a generally annular flow chamber 23 and clearance space for a sealing member 24, as discussed below. The channeling member passages 22 are each fluidly connected with the recess 21 such that the annular flow chamber 23 fluidly connects the drill member passages 12 with the channeling member passages 22; in other words, fluid flows from the drill passage(s) 12 into the annular chamber 23 prior to entering the drill passage(s) 22. The flow chamber 23 improves the flow through the fluid channeling device 10 and helps reduce backpressure within the drill string 1, as discussed below. However, the channeling device 10 may alternatively be constructed without the flow chamber 23 (i.e., without the channeling member recess 21) and with the drill member passages 12 being directly fluidly connected with the channeling member passages 22, such that the drill outlets 12*b* are located adjacent to and aligned with the channeling member input ports 20.

Further, the fluid channeling device 10 preferably further comprises a sealing member 24 disposeable between the drill member base section 11 and the channeling member 14, preferably at least partially within the interior recess 21, and configured to prevent fluid flow into the one or more drill member passages 12. That is, the sealing member 24 is configured to permit fluid flow through the passage(s) 12 in a first direction from the drill member bore 2*b* and toward the channeling member 14 but prevents flow, including both fluid flow and solid particles (drill chips C, dirt, etc.), in a second direction from the channeling member 14 and towards the central bore 2*b*. As such, the sealing member 24 is configured to prevent contaminants from entering the drill string 1 through the fluid channeling device 10. Preferably, the sealing member 24 includes a generally flexible ring 26 disposeable about the drill member base portion 11 so as to extend over the drill member passage outlet(s) 12*b*. The ring 16 is deflectable generally radially outwardly by fluid pressure within the drill member passage(s) 12 to permit flow out of the one or more outlets 12*b*. Most preferably, the sealing member 24 is provided by a polymeric "O-ring", but may alternatively be provided by any appropriate device or component capable of functioning to generally seal the drill member passage(s) 12.

Referring particularly to FIG. 8, the first and second drill members 2, 3 each preferably has an radial end surface $S_{E1}$, $S_{E2}$, respectively, generally facing the other end surface $S_{E2}$, $S_{E1}$ when the two members 2, 3 are coupled, as described below. The chalmeling member 14 is disposed between and contacted by each one of the two drill member end surfaces $S_{E2}$, $S_{E3}$, when the drill members 2, 3 are connected together, so as to thereby retain the channeling member 14 disposed on the first member base portion 11. As such, the fluid channeling device 10 is preferably integrated into an existing joint J of a conventional drill string 1, but may be incorporated into an "intermediate" or more centrally located portion of a single drill member 2 (structure not shown).

With the above arrangement, the channeling member 14 is removably installed upon and alternatively removed from the first drill member 2 (and thus also the drill string 1) by disconnecting the two drill members 2, 3, removing or installing the channeling member 14 from or on the base portion 11, and then reconnecting the two drill members 2, 3. Thus, the channeling member 14 is retained on the drill member 2 without the need for fasteners, a threaded connection, or any other means. Further, the first drill member 2 preferably further includes a shaft section 2*d* providing the base portion 11, the channeling member 14 thus being disposeable upon at least a portion of the shaft section 2*d*, the first member end surface $S_{E1}$ extending circumferentially about the shaft 2*d*. The second drill member 3 has an open end 3*a* providing the second member end surface $S_{E2}$, the first member shaft section 2*d* is disposeable within the second drill member open end 3*a* so as to connect the two drill members 2, 3, and thereby also retain the channeling member 14 disposed on the drill member portion 11 between the end surfaces $S_{E1}$, $S_{E2}$. Most preferably, the first member shaft section 2*d* has external threads 2*e* and the second drill member 3 has a threaded opening 3*b* configured to receive the shaft portion 2*d* to releasably connect the first and second drill members 2, 3, as described in further detail below.

Referring now to FIGS. 3-8, the channeling member 14 preferably includes a generally annular body 30 with a central axis 31 and inner and outer surfaces 32, 34 extending circumferentially about the axis 31. The channeling member inlet port(s) 20 are located on the body inner surface 32 and the discharge port(s) 16 are located on the body outer surface 34. The inner circumferential surface 32 defines a central bore 36 sized to receive the drill member base portion 11. Further, the annular body 30 preferably includes the interior recess 21 as described above, which is offset radially outwardly from the body inner surface 32 and extends circumferentially about the body axis 31.

Furthermore, the body outer surface 34 preferably has a generally radially-extending or angled outlet surface section 35 that faces generally toward the first drill end 1*a* when the channeling member 14 is disposed on the first drill member 2. The one or more discharge ports 16 are each preferably located on the outlet surface section 35 so as to be spaced apart circumferentially about the axis 31. Further, the channeling member passage(s) 22 are formed such that at least a portion of each passage 22 extends generally along the body axis 31, and are most preferably angled radially-outwardly so as extend through the body 30 in directions both generally parallel with and generally radially with respect to the body axis 31. As such, fluid flow through each passage 22 and out of the associated discharge port 16 is thereby directed generally toward the drill string upper end la, as discussed above and in further detail below. Additionally, the preferred annular body 30 also preferably has opposing, first and second radial end surfaces 40, 41 which are each contactable by a separate one of the body end surfaces $S_{E2}$, $S_{E3}$, respectively, for retention of the channeling member 14, as discussed above and in greater detail below.

Having described the basic components of the fluid channeling device 10 above, these and other elements of the present invention are described in further detail below.

Referring to FIGS. 1, 2 and 7, the fluid channeling device 10 of the present invention is preferably used with a conventional down-hole drill string 1 that basically includes the fluid activated percussive drill 4 and one or more drill pipes 5 or collars (none shown). The drill string 1 may use only a single fluid channeling device 10 (as shown in FIG. 1) or a plurality of fluid channeling devices 10 provided at various locations on the drill string 1, as discussed below. Preferably, the drill 4 is operated by compressed air as the working fluid F, but may be alternatively operated by another pressurized gas or even a liquid (e.g., water). The drill 4 includes a casing 6, a fluid distributing backhead 7 attached to the upper end 6*a* of the casing 6, a piston (not shown) and a chuck 8 each disposed within the casing 6. The chuck 8 retains one or more bits 9 and is impactable by the piston such that the bits are driven into and cut work material such as rock, soil, etc. The first drill member 2, which provides the drill member passage 12 and the base portion 11, is either the backhead 7, the casing 6, one of the drill pipes 5 or drill collars (none shown) of the drill string 1, and the second drill member 3 is another one of the backhead 7, the casing 6, a drill pipe 5 or a collar. Further, one fluid channeling device 10 may be provided between the backhead 7 and a proximal drill pipe 5, another channeling device 10 may be provided between two drill pipes 5, etc.

Although the fluid channeling device 10 is preferably disposed between two drill members 2, 3 so as to be retained on the first member base portion 11, such as between the backhead 7 and a drill pipe 5 (see e.g., FIG. 1), the fluid channeling device 10 may be disposed on an intermediate portion of the first drill member 2 and retained thereon by any appropriate means (e.g., a clip, key, fasteners, etc.). Further, the first drill member 2 preferably has an externally-threaded section 2*e*, most preferably on the shaft section 2*d*, and the second drill member 3 has internally-threaded section (not shown) disposed proximal to the second member open end, the two threaded sections being engageable to removably couple the first drill and second members 2, 3. Alternatively, the two drill members 2, 3 may be coupled by any other appropriate means, such as one or more lug and recess connections, keys, threaded fasteners, etc.

Referring now to FIGS. 3-5, 7 and 8, the first drill member 2 preferably has a central axis 2*f*, which is generally collinear with the drill axis 1*c*, and the base portion 11 is preferably provided by a generally circular tubular section of the drill member 2. As depicted, the drill member base portion 11 is most preferably provided on the member shaft section 2*d* and is spaced inwardly from the threaded section 2*e* thereof, but may be located at any other appropriate portion of the drill member 2. Each of the drill member passages 12 extends generally radially with respect to the axis 2*f*, preferably substantially radially but may alternatively be angled so as to extend partially axially (i.e., parallel with the member axis 2*f*) and are spaced circumferentially about the axis 2*f*.

Preferably, the one or more drill member passages 12 each extend through the base portion 11 of the first drill member 2, such that when the channeling member 14 is disposed thereon, the channeling member 14 extends circumferentially around all of the drill passages 12. Alternatively, the drill member passages 12 may extend through a portion of the drill member 2 adjacent to the base portion 11, such that the drill member passages 12 must extend at least partially axially to fluidly connect with the channeling member passages 22 (structure not shown). Further, the drill member base portion 11 also preferably has a retainer recess 46 extending radially inwardly from the outer surface 2*c* and circumferentially about the axis 2*f*. A radially innermost portion of the sealing member 24 is disposeable within the retainer recess 46 so as to maintain the member 24 positioned over the drill member outlets 12*b*.

Referring now to FIGS. 3-8, the annular body 30 of the channeling member 14 is preferably formed so as to be generally circular, but may have any appropriate shape, such as for example generally ovular, generally hexagonal, generally rectangular, etc., formed to fit about the drill member base portion 11. The body outer surface 34 preferably includes three sections 35, 37 and 39; specifically the angled surface section 35, as discussed above, an upper circumferential surface section 37 located proximal to the upper radial end surface 41 and a lower circumferential end surface 39 disposed proximal to the lower radial end surface 40 and spaced radially outwardly with respect to the upper surface section 37 (see FIG. 6). The angled outlet surface section 35 extends generally axially between the two circumferential surface sections 37, 39 such that the discharge ports 16 disposed on the angled surface section 37 direct flow therethrough generally upwardly toward the drill upper end 1*a* and generally radially outwardly, as described above. Alternatively, the outlet surface section 35 may be substantially radially extending or substantially axially extending, as opposed to being angled.

Further, the discharge ports 16 are spaced apart circumferentially about the angled outlet surface section 35 (and thus also about the axis 31) and both the channeling member passages 22 and the inlet ports 20 are spaced circumferentially about the central axis 31. Furthermore, the channeling member passages 22 are each preferably angled so as to extend generally radially-outwardly (and axially) in a direction from the associated inlet port 20 and toward the associated discharge port 16. By having this arrangement of the ports 16, the fluid channeling device 10 provides entrant flow(s) $f_E$ of working fluid F directed in the upward direction U along the axis 1*c* and toward the drill upper end 1*a*. As such, the upward entraimnent flows $f_E$ generates a partial vacuum in the lower annular portion $H_L$ of the work hole H about the drill 4, which causes drill chips C and other debris in the hole bottom end $H_B$ to be pulled or entrained into the flow and thereafter displaced to the hole top end $H_T$, as indicated in FIGS. 1 and 2.

Furthermore, the discharge ports 16 and the channeling member passages 22 are each sizeable to adjust the flow through the channeling member 14 to a desired volumetric rate. In other words, by increasing the size of the passages 22 and the ports 16, 20, the rate of flow out of the discharge ports 16 is increased, and vice-versa. The sizing of the ports 16, 20 and passages 22 may be increased by drilling, reaming or other appropriate machining operation, by removing a bushing or other insert, etc., and may alternatively be decreased by installing bushings/inserts or by welding and re-drilling the ports 16, 20 and passages 22 so as to have a smaller diameter. Additionally, the fluid channeling device 10 may include two or more channeling members 14 (none shown) each having different sized ports 16, 20 and passages 22, such that a particular one of the members 14 is used as appropriate to provide a desired flow rate.

Figure 9:
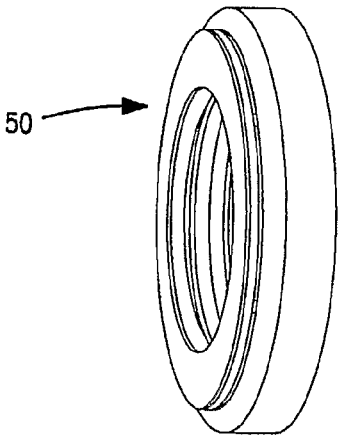
FIG. 9 is a perspective view of an obstructing member of the fluid channeling device.
Figure 10:
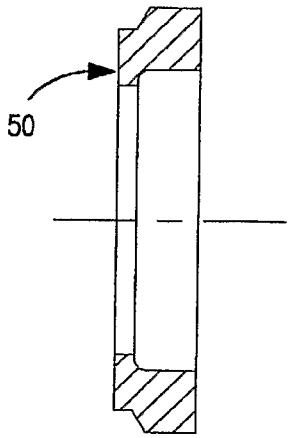
FIG. 10 is an axial cross-sectional view of the obstructing member.

Referring specifically to FIGS. 9 and 10, the fluid channeling device 10 preferably further comprises an obstructing member 50 disposeable about the drill member base portion 11 when the channeling member 14 is separate from the first drill member 2. The obstructing member 50 is preferably a generally solid annular member or ring formed without any flow passages or ports and sized to fit upon the drill member base portion 11. As such, the obstructing member 50 is configured to substantially prevent fluid flow through the drill member passages 12 when disposed about the base portion 11. Thus, when the obstructing member 50 is used in place of the channeling member 14, the fluid channeling device 10 does not generate any entrainment flow(s) $f_E$, which is beneficial when maximum fluid flow to the drill piston (not shown), is desired.

Preferably, the channeling member 14 is removably installed upon the drill member base portion 11 by first positioning the channeling member 14 at the free end of the shaft section 2*d*. Then, the channeling member 14 is displaced along the member central axis 2*f*, such that the shaft section 2*d* enters and becomes disposed within the body central bore 36, until the channeling member body 30 becomes disposed about the base portion 11. At which point, the body inner surface 32 becomes juxtaposed about the member outer surface 2*c*, the body interior recess 21 is radially aligned with the drill member retainer recess 46, and the preferred sealing member 24 is disposed partially within both recesses 21 and 46. The channeling member inlet ports 20 are then fluidly connected with the drill member passage outlets 12*b*, via the fluid chamber 23, to thereby fluidly connect the drill member bore 2*b* with the discharge ports 16. The obstructing member 50 is installed in a similar fashion to instead seal the drill member passages 12.

During use of the drill string 1 and the drill 4, a main flow F of working fluid passes through the bore 2*c* en route to being directed to the drive and return chambers (neither shown) within the drill casing 6 so as to reciprocate the piston (not shown). A portion $f_P$ of the main fluid flow F flows into each of the drill member inlets 12*a*, through the associated drill member passage 12 and out the passage outlet 12*b*, causing the sealing member 24 to deflect radially outwardly to permit the fluid portion $f_P$ to flow into the fluid chamber 23. Thereafter, fluid $F_C$ within the chamber 23 flows into the one or more channeling member inlet ports 20, through the associated channeling passages 22 and out of the discharge ports 16 to provide the upwardly directed entrainment flows $f_E$. However, when no working fluid flows within the drill member 2, the sealing member 24 prevents contaminants from entering the drill member bore 2*c* through the drill member passages 22.

The fluid channeling device 10 of the present invention provides a number advantages over previously known devices or methods for generating the entrainment flow $f_E$. The channeling device 10 is relatively easily incorporated into an existing drill string 1 by merely providing (e.g., cutting or drilling) the drill member passages 12 at any convenient location to form the base portion 11, and then installing a channeling member 14 thereon. The fluid channeling device 10 is simple to adjust by enlarging or reducing the size of the channeling member passages 22 of a single channeling member 14 or providing one or more additional channeling members 14 with different sized passages 22. The channeling device 10 is readily accessible for servicing (e.g., cleaning) or adjusting by merely disassembling the joint J to which the device 10 is proximally located. Further, the fluid channeling device 10 also enhances drill performance by reducing backpressure, as described above.

It will be appreciated by those skilled in the art that changes could be made to the embodiments or constructions described above without departing from the broad inventive concept thereof. It is understood, therefore, that this invention is not limited to the particular embodiments or constructions disclosed, but it is intended to cover modifications within the spirit and scope of the present invention as generally described herein.

I claim:

1. A fluid channeling device for a down-hole drill assembly, the drill assembly having a central axis, being advanceable into a hole in a downward direction along the axis, and including at least one drill member, the drill member having an inner circumferential surface bounding a central bore and an outer circumferential surface, the fluid channeling device comprising:

at least one passage provided within the drill member so as to extend generally between the drill member inner and outer surfaces; and a generally annular channeling member disposeable about a portion of the drill member and having at least one inlet port, at least one discharge port, and a passage extending between the inlet and discharge ports, the inlet port being fluidly connectable with the drill member passage so as to fluidly couple the central bore with the discharge port, the discharge port being configured to direct fluid generally externally of the drill assembly and generally in an upward direction along the axis.

2. The fluid channeling device as recited in claim 1 wherein the drill member central bore is fluidly connectable to a source of working fluid such that a portion of working fluid in the bore flows through the drill member and channeling member passages and out of the discharge port.

3. The fluid channeling device as recited in claim 1 wherein the drill assembly has an upper end and a lower end, the central axis extending generally between the upper and lower ends, and the channeling member discharge port is configured to direct fluid generally toward the drill assembly upper end.

4. The fluid channeling device as recited in claim 3 wherein when the drill assembly is at least partially disposed within a work hole, fluid flow out of the channeling member discharge port entrains debris located within the hole such that the debris displaces generally toward the drill upper end.

5. The fluid channeling device as recited in claim 4 wherein the work hole includes an inner circumferential surface, the drill assembly includes an outer circumferential surface spaced radially inwardly from the hole inner surface so as to define a generally annular passage, and debris entrained by the fluid flow out of the discharge port displaces generally through the annular passage.

6. The fluid channeling device as recited in claim 1 further comprising an annular sealing member disposeable generally between the drill member portion and the channeling member and configured to prevent fluid flow into the drill member passage.

7. The fluid channeling device as recited in claim 6 wherein the drill member passage has an outlet and the sealing member includes a generally flexible ring disposeable about the drill member portion so as to extend over the drill member passage outlet, the ring being deflectable generally radially outwardly by fluid pressure to permit fluid flow out of the outlet.

8. The fluid channeling device as recited in claim 1:

wherein the channeling member is removably disposeable about the drill member portion; and the channeling system further comprises a generally annular obstructing member disposeable about the drill member portion when the channeling member is separate from the drill member and configured to substantially prevent fluid flow through the drill member passage.

9. The fluid channeling device as recited in claim 1 wherein one of the drill member and the channeling member has a circumferential recess, the recess being located such that when the channeling member is disposed upon the drill member portion, the recess provides a generally annular fluid chamber located generally between the drill member portion and the channeling member, the annular chamber fluidly connecting the drill member passage with the channeling member passage.

10. The fluid channeling device as recited in claim 1 wherein the channeling member passage is sizeable to adjust the flow through the channeling member to about a desired volumetric flow rate.

11. The fluid channeling device as recited in claim 1 wherein the drill member includes a shaft section providing the drill member portion and the channeling member is disposeable upon the shaft section.

12. The fluid channeling device as recited in claim 11 wherein the drill member is a first drill member, the drill assembly further includes a second drill member with an open end, the first member shaft section is at least partially disposeable within the second member open end so as to connect the two drill members and to retain the channeling member disposed upon the first drill member.

13. The fluid channeling device as recited in claim 1 wherein:

the drill member is a first drill member and further has an end surface;

the drill assembly further includes a second drill member connectable with the first drill member and having an end surface; and the channeling member is disposed between and contacted by each one of the first and second drill member end surfaces when the two drill members are connected so as to retain the channeling member disposed on the first member portion.

14. The fluid channeling device as recited in claim 13 wherein each one of the first and second drill members is one of a backhead, a casing, a drill pipe, and a drill collar.

15. The fluid channeling device as recited in claim 1 wherein the channeling member includes a generally annular body with a central axis, first and second radial end surfaces, and inner and outer surfaces extending circumferentially about the axis, the body inner surface defining a central bore sized to receive the drill member portion.

16. The fluid channeling device as recited in claim 15 wherein the channeling member outer surface has a generally radially-extending section and the discharge port is located on the radially-extending surface section such that at least a portion of the channeling member passage extends generally along the body axis.

17. The fluid channeling device as recited in claim 15 wherein the annular body has a recess extending circumferentially about the body axis and at least one of radially-outwardly from the body inner surface and axially from one of the first and second end surfaces, the body recess at least partially defining a generally annular fluid chamber between the drill member and the channeling member when the channeling member is disposed upon the drill member base portion, the annular chamber fluidly connecting the drill member passage with the channeling member passage.

18. The fluid channeling device as recited in claim 1 wherein:

the drill member includes a plurality of the passages, each passage extending generally between the drill member inner and outer surfaces; and the channeling member has a plurality of the inlet ports, a plurality of the discharge ports and a plurality of passages each extending between a separate one of the inlet ports and a separate one of the discharge ports, each channeling member inlet port being fluidly connectable with at least one of the drill member passages.

19. The fluid channeling device as recited in claim 18 wherein the plurality of drill member passages are spaced apart circumferentially about the drill assembly axis and the plurality of channeling member passages are spaced apart circumferentially about the axis.

20. A fluid channeling device for a down-hole drill assembly, the fluid channeling device comprising:

a first drill member having an inner surface bounding a central bore, an outer surface, and at least one passage extending generally between the drill member inner and outer surfaces;

a channeling member disposeable about a portion of the first drill member and having at least one inlet port, at least one discharge port, and a passage extending between the inlet and discharge ports, the inlet port being fluidly connectable with the drill member passage so as to fluidly couple the central bore with the discharge port, the discharge port being configured to direct fluid generally externally of the drill assembly; and a second drill member connectable with the first drill member and contactable with the channeling member so as to retain the channeling member disposed upon the first drill member.

21. The fluid channeling device as recited in claim 20 wherein each one of the first and second drill members is one of a backhead, a casing, a drill pipe, and a drill collar.

22. The fluid channeling device as recited in claim 20 wherein the first drill member includes a shaft section with external threads and a radial end surface extending circumferentially about the shaft section, the channeling member is disposeable about the shaft section, and the second drill member has a threaded opening and a radial end surface extending circumferentially about the opening, the opening being configured to receive the first member shaft portion to releasably connect the first and second drill members such that the channeling member is disposed generally between the first member end surface and the second member end surface.

23. The fluid channeling device as recited in claim 20 wherein the channeling member includes a generally annular body with a central axis, first and second radial end surfaces, and inner and outer surfaces extending circumferentially about the axis, the body inner surface defining a central bore sized to receive the first drill member portion.

24. The fluid channeling device as recited in claim 23 wherein the annular body further has opposing radial end surfaces and each one of the first drill and second members has an end surface contactable with a separate one of the body end surfaces so as to retain the body disposed upon the first drill member portion.

25. The fluid channeling device as recited in claim 20 wherein:

the drill assembly has a central axis extending longitudinally and centrally through the first and second drill members, the drill assembly being advanceable into a hole in a downward direction along the axis; and the channeling member discharge port is configured to direct fluid generally externally of the drill assembly and generally in an upward direction along the axis.

26. The fluid channeling device as recited in claim 20 further comprising an annular sealing member disposeable generally between the drill member portion and the channeling member and configured to prevent fluid flow into the drill member passage.

27. The fluid channeling device as recited in claim 26 wherein the drill member passage has an outlet and the sealing member includes a generally flexible ring disposeable about the drill member portion so as to extend over the drill member passage outlet, the ring being deflectable generally radially outwardly by fluid pressure to permit fluid flow out of the outlet.

28. The fluid channeling device as recited in claim 20:

wherein the channeling member is removably disposeable about the first drill member portion; and the channeling system further comprises a generally annular obstructing member disposeable about the drill member portion when the channeling member is separate from the drill member and configured to substantially prevent flow through the drill member passage.

29. The fluid channeling device as recited in claim 20 wherein one of the drill member and the channeling member has a circumferential recess, the recess being located such that when the channeling member is disposed on the drill member portion, the recess provides a generally annular fluid chamber located generally between the drill member portion and the channeling member, the annular chamber fluidly connecting the drill member passage with the channeling member passage.

30. The fluid channeling device as recited in claim 20 wherein:

the drill assembly has a central axis extending longitudinally through the first and second drill members;

the first drill member has a plurality of the passages spaced apart circumferentially about the central axis, each passage extending generally between the drill member inner and outer surfaces; and the channeling member has a plurality of the inlet ports, a plurality of the discharge ports and a plurality of passages each extending between a separate one of the inlet ports and a separate one of the discharge ports, each channeling member inlet port being fluidly connectable with at least one of the drill member passages, the discharge ports being spaced apart circumferentially about the central axis.

31. A down-hole drill assembly comprising:

an elongated drill member having a central axis, an inner circumferential surface bounding a central bore, an outer circumferential surface, and a passage extending generally between the inner and outer surfaces, the drill member being advanceable into a hole in a generally downward direction along the axis; and a generally annular channeling member disposeable about a portion of the drill member and having an inlet port, a discharge port, and a passage extending between the inlet port and the discharge port, the inlet port being fluidly connectable with the drill member passage so as to fluidly connect the drill member central bore with the discharge port, the discharge port being configured to direct fluid generally externally of the drill assembly and generally in an upward direction along the central axis.

32. A fluid channeling device for a down-hole drill, the drill including first and second members, the first drill member having a radial end surface, an inner surface bounding a central bore and an outer surface, the second drill member having a radial end surface, the fluid channeling device comprising:

a passage provided within the first drill member and extending between the first member inner and outer surfaces; and a channeling member disposeable about a portion of the first drill member and having an inlet port, a discharge port, and a passage extending between the inlet port and the discharge port, the inlet port being fluidly connectable with the first drill member passage so as to fluidly connect the central bore with the discharge port, the discharge port being configured to discharge fluid generally externally of the drill assembly, the end surface of each one of the first and second drill members contacting the channeling member to retain the channeling member disposed about the first member portion.

* * * * *

UNITED STATES PATENT AND TRADEMARK OFFICE

CERTIFICATE OF CORRECTION

PATENT NO. : 7,665,549 B2
APPLICATION NO. : 11/628998
DATED : February 23, 2010
INVENTOR(S) : Leland H. Lyon It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 502 days.

Signed and Sealed this

Seventh Day of December, 2010

David J. Kappos

David J. Kappos
*Director of the United States Patent and Trademark Office*